United States Patent [19]

Miczka

[11] Patent Number: 5,012,951

[45] Date of Patent: May 7, 1991

[54] HOPPER FOR PRESSURIZED CONTAINER

[76] Inventor: Lothar Miczka, Feldwiesenstrasse 22, Altstätten, Switzerland

[21] Appl. No.: 55,322

[22] Filed: May 29, 1987

[30] Foreign Application Priority Data

Jun. 10, 1986 [CH] Switzerland ..... 2343/86

[51] Int. Cl.[5] ..... B21D 39/00

[52] U.S. Cl. ..... 220/626; 220/209

[58] Field of Search ..... 220/66, 68, 3, 468, 220/256, 209, 367, 626

[56] References Cited

U.S. PATENT DOCUMENTS

| | | | |
|---|---|---|---|
| 2,563,200 | 8/1951 | Venning | 220/209 X |
| 2,565,954 | 8/1951 | Dey | 222/394 |
| 2,664,222 | 12/1953 | King | 220/66 |
| 2,805,003 | 9/1957 | Ayres | 222/394 |
| 3,041,717 | 7/1962 | Brown | 220/468 X |
| 3,217,963 | 11/1965 | Abplanalp | 222/136 |
| 3,318,484 | 5/1967 | Modderno | 222/136 |
| 3,455,482 | 7/1969 | Asklund et al. | 220/44 |
| 3,625,400 | 12/1971 | Friedrich | 222/94 |
| 3,700,136 | 10/1972 | Ruekberg | 220/66 X |
| 4,349,135 | 9/1982 | Busselet | 222/394 |
| 4,515,285 | 5/1985 | Euscher-Klingenhagen et al. | 220/66 X |

FOREIGN PATENT DOCUMENTS

| | | |
|---|---|---|
| 793388 | 11/1936 | France . |
| 1203920 | 1/1960 | France . |
| 2078188 | 2/1971 | France . |
| 2546131 | 5/1984 | France . |

*Primary Examiner*—Steven M. Pollard

[57] ABSTRACT

A hopper for use with a hollow cylindrical container open at one end. The open container end has an exposed edge. The hopper comprises a plurality of at least two partial hoppers, the partial hoppers extending generally at right angles to the axis of the container and being disposed one below the other. All partial hoppers are secured together, each partial hopper having an outer periphery of the same shape as the periphery of the open container end. At least the uppermost partial hopper has its peripheral edge secured to the exposed edge of the open container end. All partial hoppers have a common opening spaced inwardly from the peripheries of the partial hoppers and have a common center aligned with the axis of the container.

3 Claims, 2 Drawing Sheets

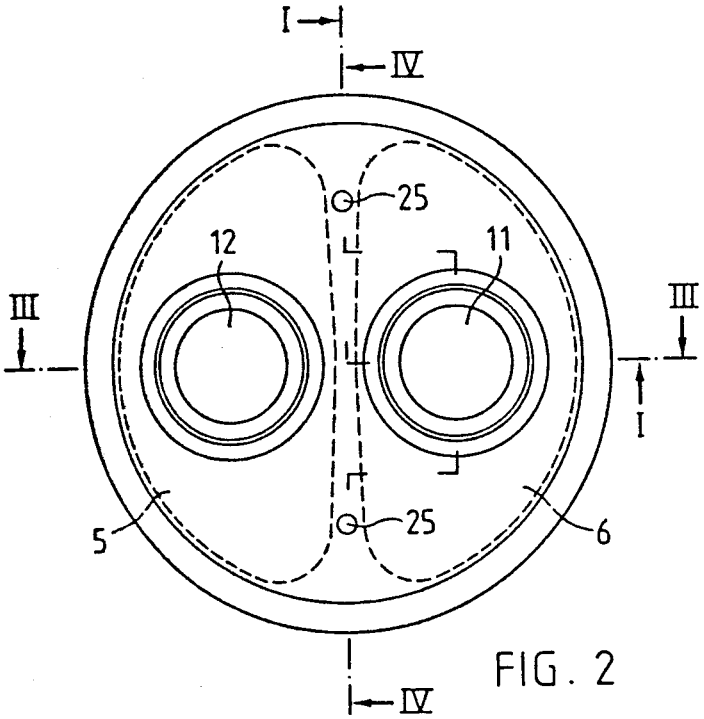
FIG. 2
FIG. 5
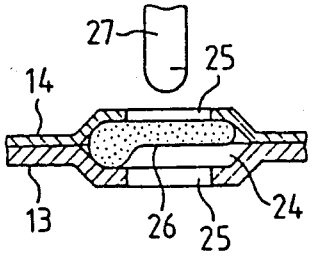
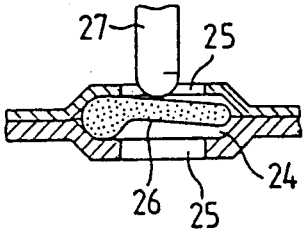
FIG. 6
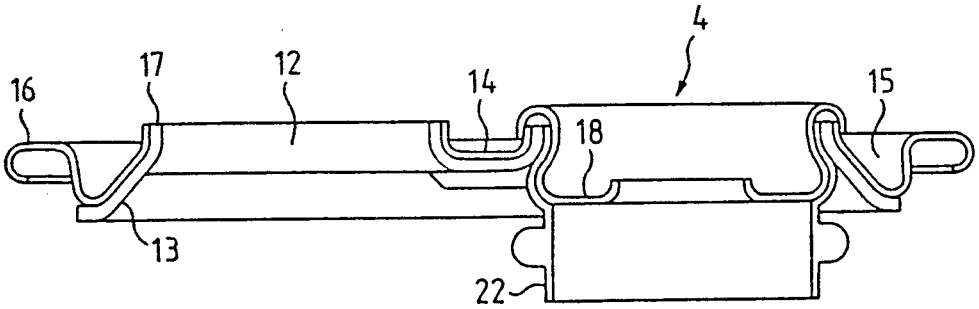
FIG. 3
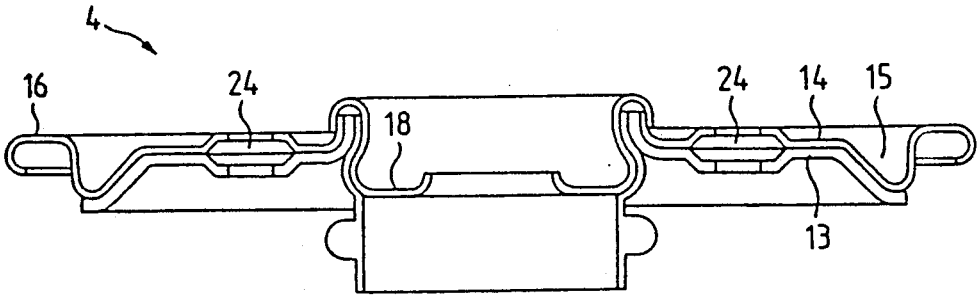
FIG. 4

HOPPER FOR PRESSURIZED CONTAINER

BACKGROUND OF THE INVENTION

This invention relates to hoppers for use with pressurized containers.

Pressurized containers which are frontally sealed at their upper ends by hoppers are known in numerous different constructional forms. In the simplest construction, the pressure container is a cylindrical vessel with a capacity of 100 to 1000 ml and made from aluminium or tin plate. The hopper, i.e. the upper frontal termination or seal, is either an integral part of the vessel or is connected as a separate component to the container body by flanging. The hopper has an opening, which is closed by a disk or plate having a seal. The seal is generally constructed as a manually operable valve, which permits the discharge of the contents as foam, powder, paste or a liquid jet. The pressure container is a completely sealed unit, which eliminates the problem of undesired outflow or atmospheric oxidation of the content. The content essentially comprises a vapour phase as a blowing or foaming agent, a liquid phase constituted by the active substances, the blowing or foaming agent being dissolved in the liquid phase.

Another known type of pressurized container employs a dosed delivery of a number of chemically reactive products, which may only come into contact with one another immediately prior to use. Such a two-component product is e.g. constituted by a polyurethane foam, which is used in many places and ways, e.g. in the building trade for in situ foaming.

The use of pressurized containers for such multicomponent products generally requires the use of larger container voumes. The components are housed in separate partial containers within the pressure container and subject to the action of a gas propellant, optionally using a plunger or piston, which separates the gas propellant filling from the partial containers. However, much higher pressures are required for mixing highly viscous components than in the case of simple pressurized containers.

When higher pressures are needed for multicomponent containers, the pressurized containers must be dimensioned for these higher pressures. When the hopper is manufactured together with the frame or body, this means a relatively complicated solution, because the container body wall thickness would be smaller than that of the hopper. When, as in the case of tin plate pressurized containers, the hopper is made from a separate piece with a greater wall thickness, flanging to the body edge causes problems and in the case of a convex hopper, there is not sufficient space for providing an outlet, e.g. a valve for each partial container, so that special outlets must be designed.

SUMMARY OF THE INVENTION

It is an object of the present invention to provide a hopper so constructed as to withstand without difficulty high pressures present in pressurized containers.

Another object is to provide a hopper of the character indicated that can also be connected to one or more standard values.

Yet another object is to provide a hopper of the character indicated that can be manufactured at relatively low cost.

In accordance with the principles of the invention, the hopper is adapted for use with a hollow cylindrical container open at one end. This open end has an exposed edge.

The hopper comprises a plurality of at least two partial hoppers. These partial hoppers extend generally at right angles to the axis of the container and are disposed one below the other. All partial hoppers are secured together, each partial hopper having an outer periphery conforming in shape to that of the periphery of the open container end.

The peripheral edge of at least the uppermost partial hopper is secured to the exposed edge of the open container end, as for example by flanging. All partial hoppers have at least one common opening spaced upwardly from the peripheries of the partial hoppers and have a common center aligned with the axis of the container.

Thus, the hopper is constructed as a wall formed from two or more superimposed, attached partial hoppers, in which there is at least one opening for receiving an operable closure. Due to the fact that the hopper is constructed in this form, cost-effective manufacture is obtained by using hopper parts having a smaller wall thickness. It is possible to form the wall of the hopper as an e.g. partly profiled, but substantially uncurved disk.

A particularly favourable construction is obtained with a hopper constructed with two partial hoppers, an upper and a lower, wherein the lower partial hopper has a smaller diameter than the outer partial hopper. Under these conditions, the upper partial hopper alone can be beaded to the body edge of the containers, thus providing a completely satisfactory and economical solution.

The aforementioned objects and advantages of the invention as well as other objects and advantages thereof will either be explained or will become apparent to those skilled in the art when this specification is read in conjection with the accompanying drawings and specific description of preferred embodiments which follow.

BRIEF DESCRIPTION OF THE DRAWINGS

FIG. 2 is a plan view of the structure shown in FIG. 1.

FIG. 3 is a sectional view taken along line III—III of FIG. 2, but drawn to a larger scale.

FIG. 4 is a sectional view taken along line IV—IV in FIG. 2 but drawn to a larger scale.

FIG. 5 is a detail drawn to a larger scale of a portion of the structure shown in FIG. 4 illustrating venting means in closed position.

FIG. 6 is a view similar to FIG. 5 but illustrating the venting means in open position.

DETAILED DESCRIPTION OF THE PREFERRED EMBODIMENTS

Figure 1:
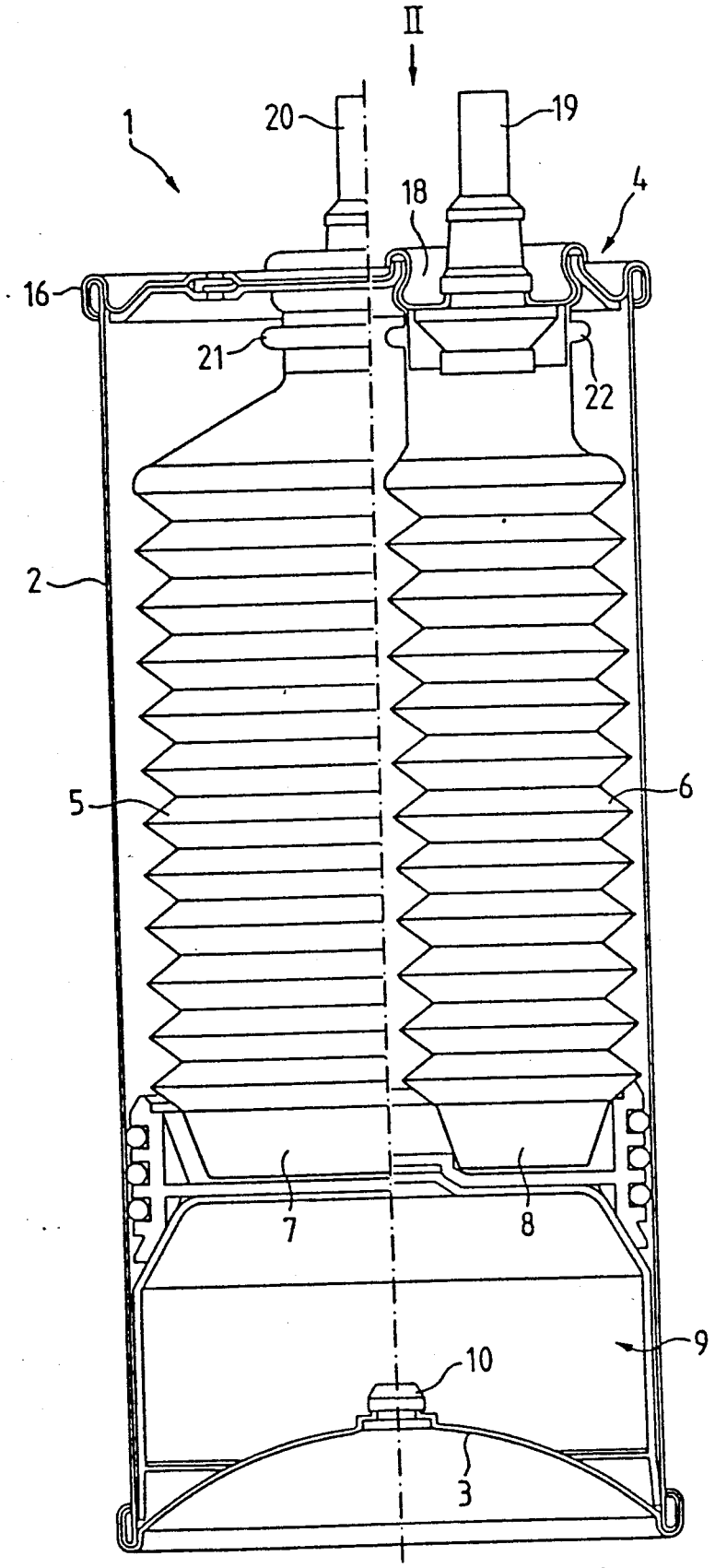
FIG. 1 shows in longitudinal section a pressurized container with a hopper in accordance with the invention as taken along line I—I in FIG. 2.

FIG. 1 shows a pressurized container 1, which comprises a cylindrical container body or frame 2, an inwardly curved bottom 3 and a hopper 4. There are two partial containers 5, 6, each filled with a pressure component within the pressure container 1. Partial containers 5, 6 have a bottom 7, 8 supported on a piston 9. Piston 9 is subject to the action of a gas propellant filling located in the space between bottom 3 and the underside of piston 9 and is introduced through an opening closed by a closure 10.

Various known forms of internal construction of pressurized container 1 can be used. Thus, e.g. the piston could be omitted, so that the gas propellant filling would surround the partial containers 5, 6. The number of the partial containers 5, 6 can also vary. In place of two partial containers, there could be a single partial container or more than two partial containers in pressure container 1. The pressure container could also be of the simplest type whose unseparated content comprises a vapour phase, e.g. a blowing or foaming agent and a liquid phase, e.g. the active substances and the blowing or foaming agent dissolved therein.

The pressurized container 1 shown in FIG. 1 illustrates an advantageous application of the invention. Due to the two partial containers 5, 6 housed in pressure container 1, the latter is relatively large. In order to obtain proper mixing of the highly viscous components, the pressure of the gas propellant filling must be relatively high, e.g. 10 to 15 bar or higher, so that the mixing of the components with a constant ratio can be ensured through out the emptying process.

unlike known hoppers, hopper 4 has an uncurved shape, so that the arrangement of openings 11, 12 is facilitated, cf FIG. 2. This applies to an increased extent when arranging three or four openings, which must be provided as the number of partial containers housed in the pressurized container increases.

As shown in FIGS. 3 and 4, hopper 4 is constructed as a multiple wall, in FIGS. 3 and 4 as a double wall, which comprises an inner (or lower) partial hopper 13 and an outer (or upper) partial hopper 14. In all, hopper 4 forms an uncurved, approximately planar disk, whose partial hoppers 13, 14 are joined to one another e.g. by spot welding or bonding. On partial hoppers 13, 14, hopper 4 can have a groove 15 in the region of the circumference thereof. The outer partial hopper 14 has a larger diameter than the inner partial hopper 13. As shown in FIG. 1, the diameter of the inner partial hopper 13 approximately corresponds to the internal diameter of the container body 2. The projecting edge 16 of the outer partial hopper 14 is used for forming the flanging or beading with the body edge, as shown in FIG. 1.

On the circumference of openings 11, 12, the two partial hoppers 13, 14 are shaped to form an edge 17, remote from the inner partial hopper 13 and projecting roughly perpendicularly from the hopper plane.

Openings 11, 12 are used for securing the valves 19, 20 associated with the individual partial containers 5, 6 to the hopper. For this purpose the valves 19, 20 can be mounted in a valve disk 18, which is crimped to the hopper. In the same way, valve disk 18 can be crimped to edge 17. Due to the fact that edge 17 has the wall thickness of the two partial hoppers 13, 14, there is no need to roll it. Additionally the partial containers 5, 6 can be secured to edge 17 at the same time as the valve disc is crimped. For this purpose, the partial containers 5, 6 can have socketlike neck parts 21, 22, each of which is placed together with valve disk 18 over edge 17 and then crimping action takes place. Neck parts 21, 22 simultaneously serves as seals, so that partial containers 5, 6 form a completely sealed unit. If pressurized container 1 has no partial containers, the connection is sealed by inserting a sealing ring.

The double wall of hopper 4 also offers the advantage of providing a venting means 23, in addition to the openings 11, 12 used for sealing valve disk 18 and valves 19, 20. By locally bending up partial hoppers 13, 14, a cavity 24 is provided for said means and is connected by passages 25 between the interior of pressurized container 1 and the external atmosphere.

FIGS. 5 and 6 show cavity 24 with a venting means housed therein on a larger scale. An elastic tongue 26 is placed in cavity 24 and is shaped in such a way that it resiliently engages on passage 24 of the outer partial hopper 14. Tongue 26 can be pressured down by a pin 27, cf FIG. 6, so that the interior of pressurized container 1 is connected by passages 25 to the external atmosphere. This connection is necessary if the components located in partial containers 5, 6 are discharged and mixed. The interior of pressure container 1 is made smaller by piston 9 subject to the action of the gas propellant filling. By pressing down tongue 26, the air in pressurized container 1 can escape.

Due to its planar construction, the described hopper 4 has sufficient space for housing several valves 19, 20. Through the connection of two partial hoppers 13, 14, it can be made sufficiently strong to enable it to reliably absorb the pressures which occur within pressurized container 1. The manufacture of hopper 4 is facilitated through the use of partial hoppers, because the relatively thin-walled partial hoppers can be inexpensively manufactured by punching or deep drawing.

Different materials can be used for hopper 4. Suitable material are metals, e.g. sheet metal, particularly tin plate, aluminium and alloys thereof, as well as plastics with and without a reinforcement, together with composite metal - plastic materials.

While the fundamental novel features of the invention have been shown and described and pointed out, it will be understood that various substitutions and changes in the form of the details of the embodiments shown may be made by those skilled in the art without departing from the concepts of the invention as limited only by the scope of the claims which follow.

What is claimed is:

1. A hopper for use with a hollow cylindrical container having an axis and open at one end, the open container end having an exposed edge, said hopper comprising a plurality of at least two partial hoppers, the partial hoppers extending generally at right angles to the axis of the container and being disposed one below the other, all partial hoppers being secured together, each partial hopper having an outer periphery of the same shape as the periphery of the open container end, at least the uppermost partial hopper having its peripheral edge secured to the exposed edge of the open container end, all partial hoppers having a common opening spaced inwardly from the peripheries of the partial hoppers, the peripheral edge of the uppermost hopper and the peripheral edge of the open container end being flanged together, the partial hoppers defining a partially profiled and substantially flat disc; the partial hoppers having in common a raised peripheral edge surrounding the common opening which extends upwardly above and away from the open container end, and further including a valve seal secured to the raised edge and enclosing the common opening, wherein:

the plurality of partial hoppers is equal to two, both partial hoppers being circular, the diameter of the upper hopper being larger than the diameter of the lower partial hopper;

the partial hoppers are provided with at least one cavity and passages connecting the cavity to the interior of the container for venting; and an elastic tongue is disposed in the cavity, said tongue having a closed position at which venting is blocked and an open position at which venting is not blocked, the tongue being normally held in closed position by spring tension and being adapted to be moved into open position when a pin is inserted from the outside of the upper hopper into the cavity and engages the tongue.

2. A hopper for use and having in cross section the shape of a circle with a hollow cylindrical container open at one end, the open container having an exposed edge, said hopper comprising two partial hoppers which extend generally at right angles to an axis of the container and are disposed one below the other, the partial hoppers defining a partially profiled and substantially flat disc, both partial hoppers being circular, the diameter of the upper partial hopper being larger than the diameter of the lower partial hopper, all partial hoppers being secured together, the upper partial hopper having a peripheral flange secured to the edge of the container open end, the lower partial hopper having no peripheral flange, all partial hoppers having a common opening spaced inwardly from the peripheries of the partial hoppers, the partial hoppers having in common a raised peripheral edge surrounding the common opening which extends upwardly above and away from the open container end, and further including a valve seal secured to the raised edge and enclosing the common opening.

3. The hopper of claim 2 wherein the partial hoppers have different thicknesses, the lower partial hopper being thicker than the upper partial hopper.

* * * * *